US006308548B1

(12) United States Patent
Schwochert et al.

(10) Patent No.: US 6,308,548 B1
(45) Date of Patent: Oct. 30, 2001

(54) DEBURRING APPARATUS

(76) Inventors: John P. Schwochert, 5020 Petrack La.; David J. Petrack, 5025 Petrack La., both of Omro, WI (US) 54963

( * ) Notice: Subject to any disclaimer, the term of this patent is extended or adjusted under 35 U.S.C. 154(b) by 0 days.

(21) Appl. No.: 09/449,409

(22) Filed: Nov. 26, 1999

(51) Int. Cl.[7] ..... B21D 19/04
(52) U.S. Cl. ..... 72/126; 472/713
(58) Field of Search ..... 408/211, 713; 72/75, 124, 126; 15/88, 104.3, 104.4, 104.5, 104.9

(56) References Cited

U.S. PATENT DOCUMENTS 909,182 * 1/1909 Hart ..... 72/124
3,973,861 * 8/1976 Sussmuth ..... 408/713

FOREIGN PATENT DOCUMENTS

258821 * 10/1989 (JP) ..... 72/124

* cited by examiner

*Primary Examiner*—Steven C. Bishop
(74) *Attorney, Agent, or Firm*—R. Jonathan Peters

(57) ABSTRACT

An apparatus for deburring the marginal edge of a cylindrical body, comprising a substantially enclosed cylindrical housing having (i) a circular hub, (ii) a continuous, open channel circumscribing the hub, and (iii) a circumferential rim disposed radially from the channel. The channel has (i) an inner sidewall defining the outer wall of the hub and an outer sidewall defining the inner wall of the rim, and (ii) a laterally disposed annular boss interconnecting inner and outer sidewalls so as to connect the hub and rim. A plurality of first, spaced elongated slots and second, spaced elongated slots are formed at opposed peripheries of the boss, and the first slots open through a portion of the inner sidewall and the second slots open through a portion of the outer sidewall; and the first slots are offset from the second slots and disposed radially outwardly from the first slots. A plurality of first pins are seated in the first slots so that a portion of each of the first pins protrudes outwardly from the periphery of the inner sidewall and into the channel; and a plurality of second pins seated in the second slots so that a portion of each of the second pins protrudes outwardly from the periphery of the outer sidewall and into the channel, whereby the second pins are disposed concentric to and outwardly from the first pins and offset therewith so that each of the second pins is disposed between adjacent first pins. A spring biases the first pins and the second pins radially in opposite directions toward each other and to be displaceable radially in opposite directions.

20 Claims, 10 Drawing Sheets

DEBURRING APPARATUS

BACKGROUND OF THE INVENTION

This invention relates to a deburring apparatus, and to the method of deburring. In it's more specific aspect, this invention relates to an apparatus for deburring the cut or marginal edges of cylindrical bodies, such as metal tubes (e.g., steel tubes) or the like, and to the method of accomplishing this deburring operation.

FIELD OF THE INVENTION

Cylindrical metal bodies, such as metal tubing, typically formed by seam welding, extrusion or other suitable forming means, is cut by a suitable tool or knife to the desired length depending upon the end use application. The cutting tool produces a rough, ragged or jagged edge on the tube, that is, burrs are formed along the cut edges or marginal edges of the metal tube or workpiece, which can interfere with or jeopardize the performance of the cylindrical metal body, and can result in poor joints between connecting tubes. Also, the burrs can be hazardous to the worker. Numerous devices have been developed for removing the burrs from the cut edges, including rotary milling heads, rollers, stationary scraping blades, and hand files or other such abrasive devices. The devices known in the art are either complicated, or not altogether successful in providing a smooth, deburred edge. Furthermore, and most significantly, known deburring tools have been known to deform the metal workpiece.

A number of tubular work pieces are formed by seam welding, and it is usually necessary to deburr the marginal edges of the tube. Most known deburring tools can catch on the weld seam, thereby inhibiting a proper or complete finishing. Moreover, if the deburring tool is rotated at a relatively high speed, the tool can grab the work piece and spin it out of control or even throw the work piece free of the worker, and is therefore hazardous. In addition, a metal tube usually has irregularities, most notably being out-of round (not a perfect circle), which also inhibits the deburring operation or makes it impossible to perform.

In addition, most deburring apparatus that are known or available are capable of deburring one side only of the edge, i.e., the inside edge or the outside edge. Consequently, the operation either must be done in two steps, or one side only is deburred and the other side remains unfinished.

This invention has therefore as its purpose to provide a deburring apparatus which is easy to operate, and deburrs the cut edge or marginal edge of a cylindrical metal body or workpiece.

It is another object of the invention to provide a deburring apparatus which can deburr a metal workpiece having irregularities, including a workpiece that is out-of-round, and that has a weld seam.

It is another object of the invention to provide a deburring apparatus which produces a smooth or deburred edge on a cylindrical metal body or workpiece, and does not deform the workpiece.

Still another object of the invention is to provide a deburring apparatus which can deburr an angled cut in the marginal edge of the work piece.

Yet another object of the invention is to provide a deburring apparatus which is capable of deburring concomitantly both sides of an edge of the workpiece.

It is another object of the invention to provide a method for deburring the cut edge or marginal edge of a tubular or cylindrical metal body or workpiece utilizing the apparatus of the invention in stepped sequence.

SUMMARY OF THE INVENTION

In accordance with the present invention, the apparatus for deburring the cut or marginal edge of a substantially cylindrical metal body or workpiece, such as a metal tube or the like, comprises a substantially enclosed, cylindrical housing, adaptable for rotatable mounting. The cylindrical housing includes a cap or top section, and a bottom section having a substantially planar, exterior, bottom face or surface which is about normal to the cylindrical wall, and an open continuous channel. The two sections desirably are of equal diameter, and when joined or connected form a cylindrical housing of a substantially uniform circular dimension. The housing desirably includes appropriate means, such as a spindle or shaft extending outwardly from the cap or top section of the housing for insertion into the chuck of a machine, for rotating the housing.

The term "substantially enclosed cylindrical housing" as used herein and in the appended claims is intended to include or describe a housing that may have one or more openings or apertures in the facing or wall or walls of the housing to allow for venting of heat build-up and to facilitate cleaning of the apparatus.

The metal workpiece can be any of the several metals used in the fabrication of tubular bodies. These metals include, for example, steel, steel alloys, stainless steel, aluminum and brass.

It should be understood that such terms as "longitudinal", "radial", "axial", "transverse", "normal", and "perpendicular" are used herein and in the appended claims in reference to the center longitudinal axis of the housing, unless otherwise noted.

In accordance with the our invention, the bottom section has first and second opposed, substantially parallel surfaces. The first or exterior surface or face, which is the exterior face includes (i) a central hub, (ii) a first, continuous, open channel circumscribing the hub, and (iii) a circumferential rim extending from the channel to the perimeter of the cylindrical wall. This first channel, which opens outwardly from the exterior face of the bottom section, comprises spaced side walls, thereby forming an inner side wall, defining the outer periphery of the hub, and an outer side wall, defining the inner periphery of the rim. The channel terminates at the second or interior face of the bottom section forming a land or boss integral with the side walls, and thereby interconnecting the hub and rim.

The second or interior surface of the bottom section includes an axial center cavity or recess having a defined inner surface. The land or boss circumscribes the center cavity and terminates at its outside circumference at the outer wall of the channel. A second continuous channel or recess, opening to the interior of the bottom section, circumscribes the land.

A plurality of spaced, first and second slots extend transversely through the land and open to the first channel longitudinally along the periphery of the inner wall and outer wall of the first channel, respectively, and provide an appropriate seat for pins arranged or inserted in each slot. As viewed from the interior face of the bottom section, the first elongated slots open onto the center cavity, and the second elongated slots open onto the second channel. The first and second slots are offset and each lie on common circles which are concentric. As a result, each of the first slots is disposed adjacent a pair of second slots, and vice-versa, thereby defining a zigzag pattern such that it is equi-distance between each first and second pin.

The apparatus of our invention further includes a plurality of first spaced apart pins freely seated in the first elongated slots, that is, disposed on a common circle about the longitudinal axis as the center. A portion of each pin protrudes through the slot of the inner wall of the first channel and outwardly therefrom and into the first channel, as viewed from the bottom. A seat or ledge formed at about the periphery of the hub accommodates or provides a suitable seat for each pin. Similarly, a plurality of second spaced apart pins are freely seated in the second elongated slots and disposed concentric to and outwardly from the first pins and offset therewith, so that a portion of each second pin protrudes from the slot in the outer wall and outwardly therefrom and into the first channel and between adjacent first pins, as viewed from below. Thus, as a result of this disposition of the pins, a portion of the longitudinal surface of each of the first and second pins protrudes in opposed directions from the opposite channel walls.

Each of the first and second pins have a substantially cylindrical section and a substantially convex terminus, as viewed in longitudinal elevation. A portion or section of the convex terminus and a portion or section of the cylindrical section of each of the first and second pins protrude radially from opposite walls of the first channel. Suitable means, such as a spring bias means disposed in the axial center cavity of the bottom section, is incorporated in the housing to bias the first pins radially outwardly relative to the center longitudinal axis, and similarly there are suitable means, such as a spring bias means disposed in the second channel, to bias the second pins radially inwardly relative to this longitudinal axis. In this manner, the pins are biased radially and in opposite directions toward each other. A cap or top section is mounted atop the assembly to retain the assembly in place.

In a preferred embodiment of the invention, each of the first and second pins, which preferably are elongated and have a circular cross-section, have an upper cylindrical section of a first diameter, an inwardly directed annular shoulder, a coaxial second cylindrical section extending from the shoulder and of a smaller diameter than the first diameter, and a convex terminus. The pins are seated in the housing as described above, and are free to rotate upon rotation of the housing when the cylindrical workpiece to be deburred is brought into engagement with the pins, as explained below in detail. A portion of the convex terminus and of the second smaller diameter section of each of the first and second pins protrude from the slots into the first channel from opposite directions. When viewed in plan, the oppositely disposed surfaces of the cylindrical sections of each of the first and second pins lie on concentric circles. Thus, the outwardly disposed cylindrical surfaces of the first pins lie on a common circle of greater diameter than the common circle formed by the inwardly disposed cylindrical surfaces of the second pins. However, in the deburring operation, as explained below in detail, pressure applied against the pins by the metal body being fabricated separates the first and second pins in opposite directions against the bias, and as a consequence the oppositely disposed surfaces of the cylindrical sections of each of the first and second pins lie on concentric circles, but the diameter of the circle defined by the first pins is smaller than the diameter of the circle defined by the second pins.

Preferably, the upper cylindrical section of each pin has a convex terminus, which extends beyond or upwardly from the slot in the land or boss. The cap or top section of the housing is provided with a plurality of recesses which are adaptable to receive the convex termini. When the cap is joined or connected to the bottom section of the housing, the pins are retained in position.

Broadly, in accordance with the invention, deburring of a cylindrical metal body or tube is effected in three steps. As the housing is rotated, the first deburring step occurs when the tube is brought or set, manually or mechanically, into contact or engagement with the deburring apparatus or tool, and the tube contacts the convex bottom portion or terminus of the first and second pins. Upon contact between the edge of the workpiece and the convex termini, the pins rotate and the edge of the workpiece is deburred at least partially during this first step or stage of the operation. The second step occurs as the tube continues to rise or be inserted into the zone between the first and second pins and into engagement or contact with the smaller diameter section of the first and second pins. The pressure applied against the pins displaces the pins radially in opposite directions relative to the center longitudinal axis of the housing, and thereby separating the first and second pins so that the tube contacts the wall of smaller diameter section of each pin. The third step occurs when the tube is raised or inserted so that the marginal edge of the tube abuts the annular step or shoulder of each pin. It will be observed that as the tube is brought into contact with the pins, the wall of the tube separates the pins but the bias means forces the pins against the tube to maintain contact between the pins and the workpiece, and rotation of the pins continues to effect deburring of the marginal edge of the workpiece during the three process steps. The housing rotates which in turns causes the free seated pins to rotate as the tube is brought into engagement with the pins, and the pins deburr the tube in these three steps.

DETAILED DESCRIPTION OF THE INVENTION

Figure 1:
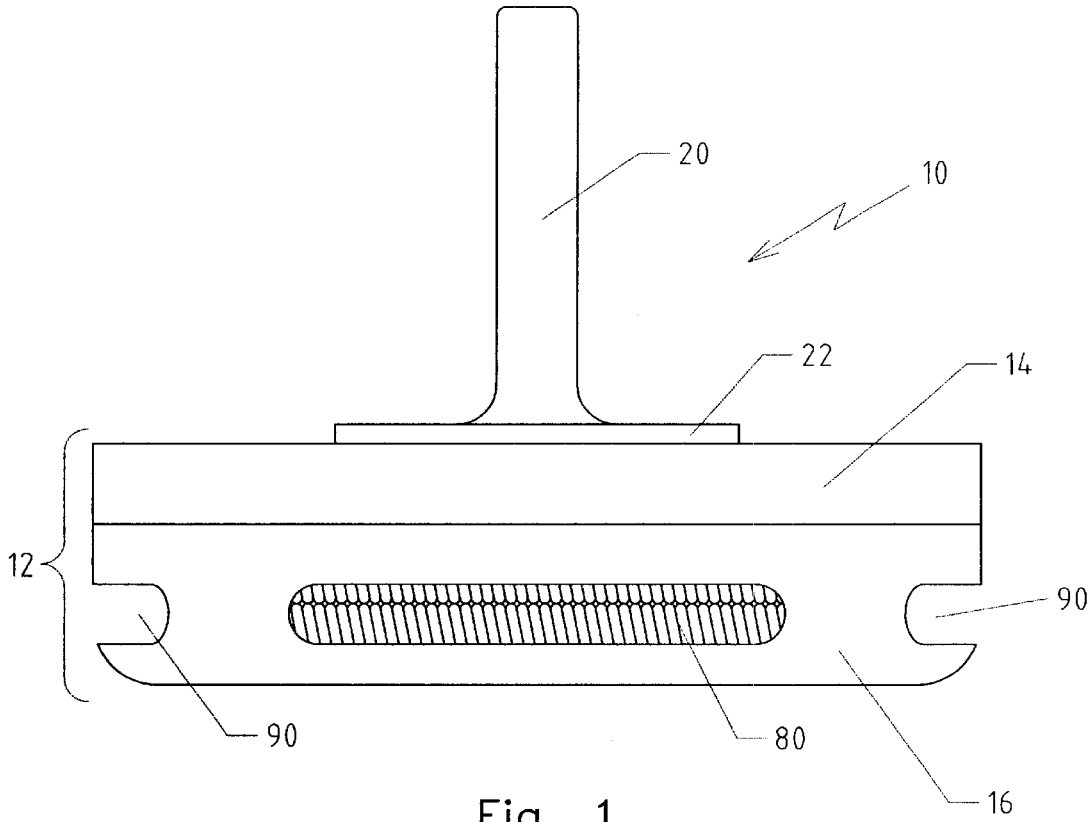
FIG. 1 is an elevational view of the assembled device or deburring apparatus of the present invention.
Figure 2:
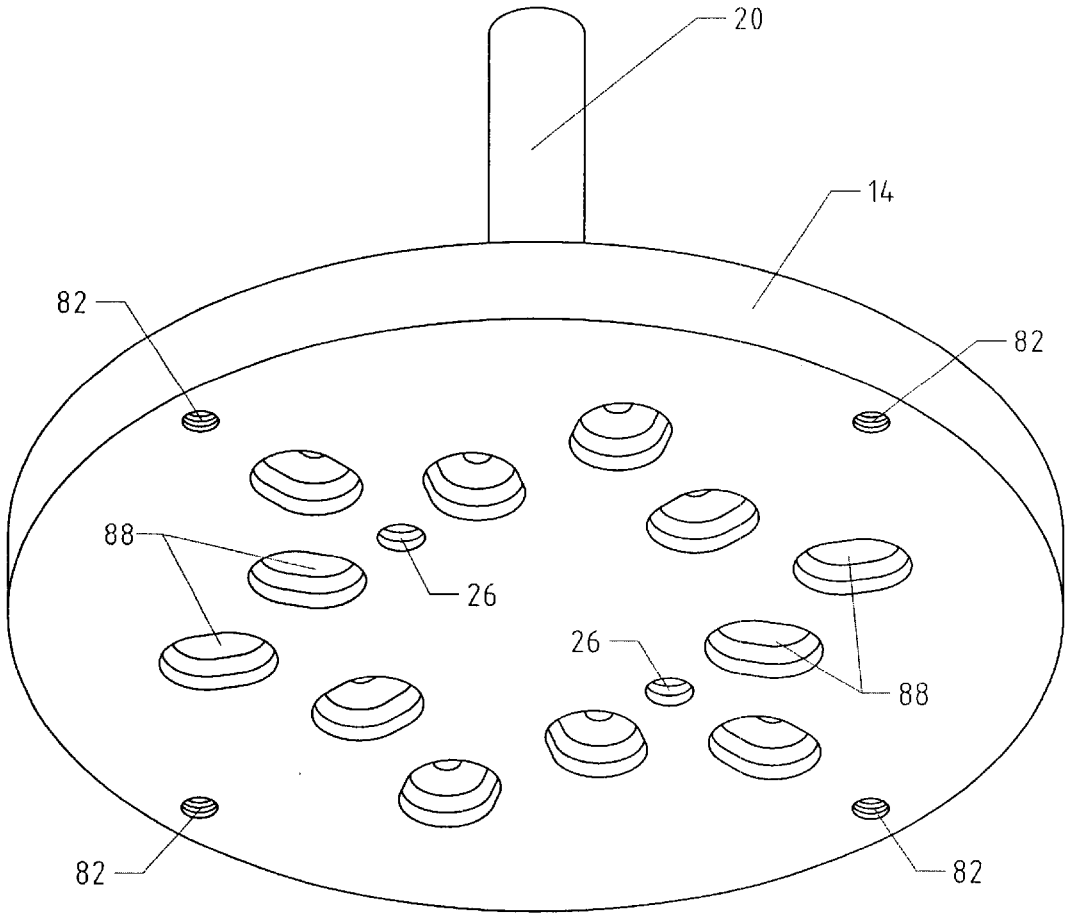
FIG. 2 is a perspective view of the top section of the apparatus of FIG. 1, as viewed from underneath.
Figure 3:
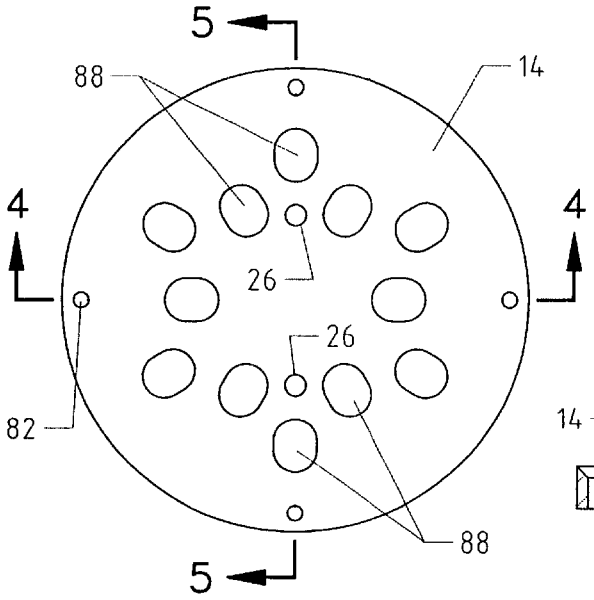
FIG. 3 is a plan view of the top section of the apparatus of FIG. 2, as viewed from underneath.
Figure 5:
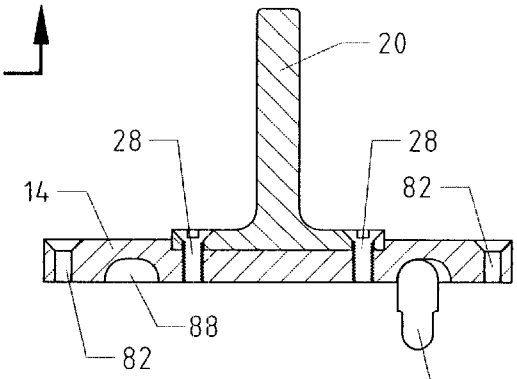
FIG. 5 is an elevational view in cross-section of the top section on line 5—5 of FIG. 3, with one pin in place.
Figure 4:
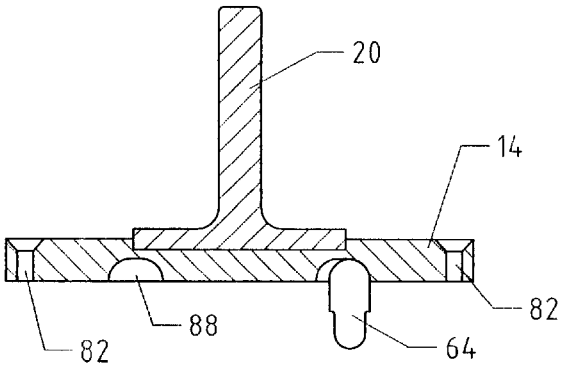
FIG. 4 is an elevational view in cross-section of the top section of the apparatus on line 4—4 of FIG. 3, with one pin in place.
Figure 6:
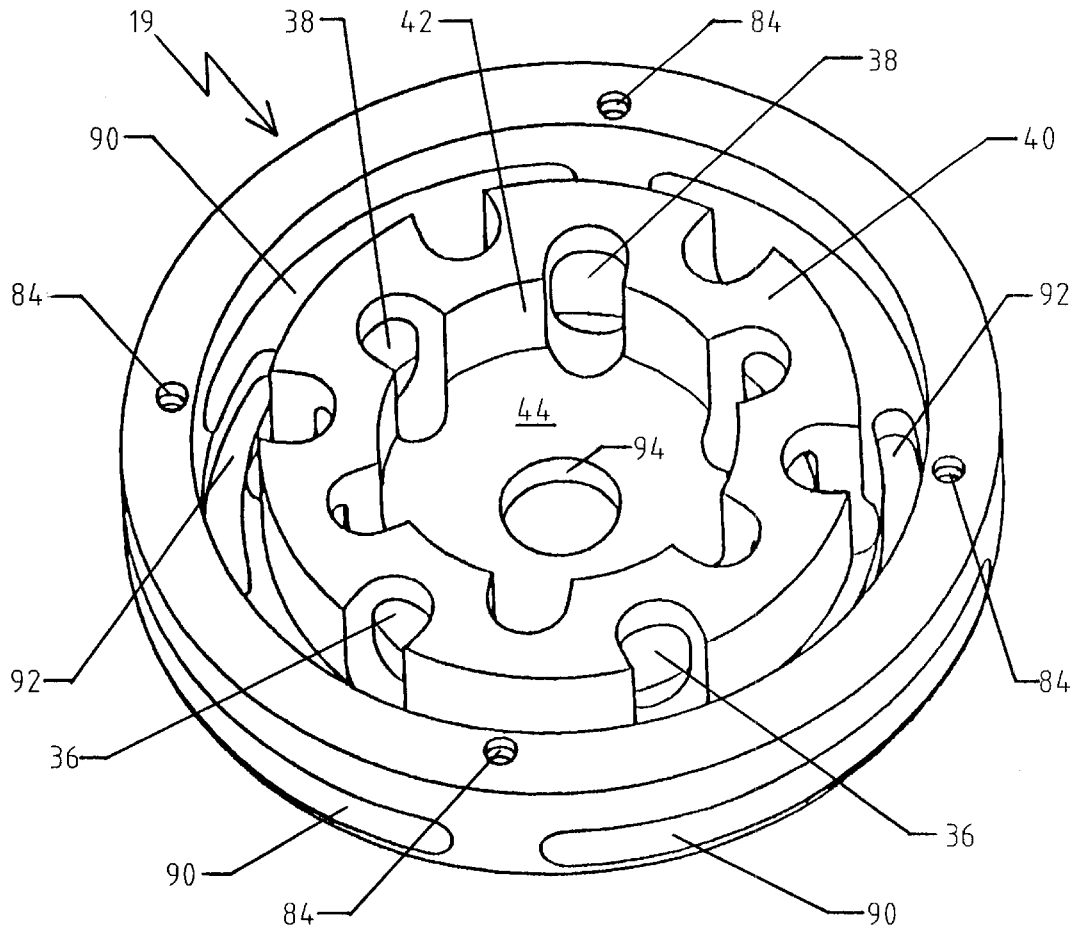
FIG. 6 is a perspective view of the bottom section of the deburring apparatus, as viewed from above.
Figure 7:
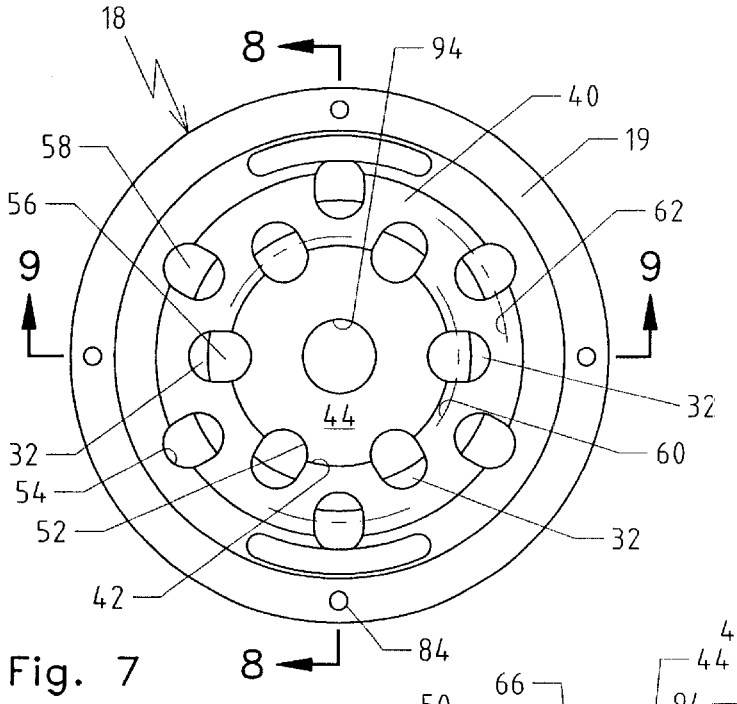
FIG. 7 is a plan view of the bottom section of FIG. 6, as viewed from above.
Figure 8:
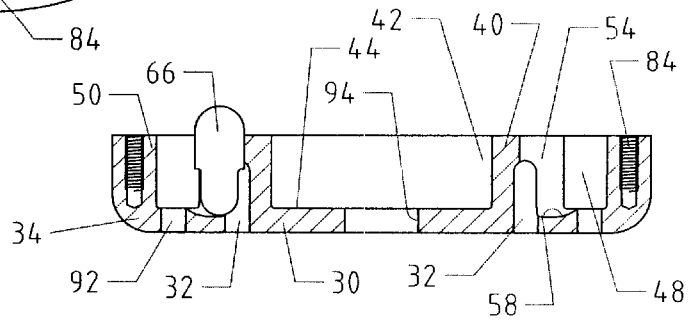
FIG. 8 is an elevational view in cross-section of the bottom section on line 8—8 of FIG. 7, with one pin in place.
Figure 9:
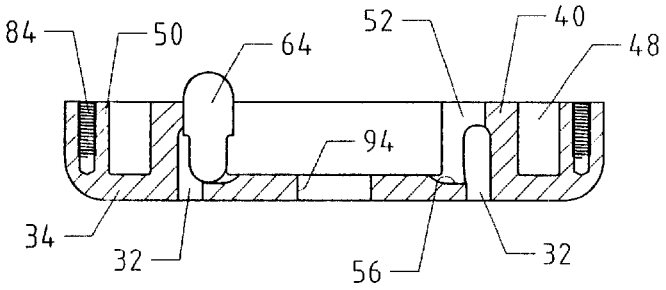
FIG. 9 is an elevational view in cross-section of the bottom section on line 9—9 of FIG. 7, with one pin in place.

Referring to the drawings wherein the same reference numerals refer to similar parts throughout the various views, there is shown in FIG. 1 a deburring apparatus of the present invention and indicated in general by the numeral 10. The deburring apparatus comprises a generally cylindrical housing 12 having a cap or top section 14 and a bottom section 16. The two sections, top 14 and bottom 16 both of which are cylindrical, are of equal diameter so when joined the exterior cylindrical walls are flush so as to leave no protuberances. The housing is generally enclosed at the bottom with the substantially planar surface or facing 18, and the perimeter of surface 18 coincides with the marginal edge of the cylindrical housing. It will be observed that the diameter of the housing 12 will varying depending upon the diameter of the workpiece. That is, the larger the diameter of the workpiece, the larger the diameter of the housing in order to accommodate the workpiece.

A spindle or shaft 20 extends outwardly or upwardly from the cap 14 for connection or insertion to the chuck of a machine (not shown). The machine, when powered, will effect rotation of the cylindrical housing 12. The spindle 20 may be formed integrally with the cap, or formed as a separate piece and connected to the cap with appropriate means. For example, the base of the spindle can be flared at 22, and this base and cap can be provided with aligned holes at 26, respectively, for receiving a suitable threaded bolt 28 or the like. In this manner, the spindle can be replaced and used on different size housings depending upon the diameter of the workpiece. Also, if the spindle should break or be damaged, it is easier or far less costly to replace the spindle than to replace the complete apparatus.

In accordance with the invention, the bottom section of the housing includes a first exterior face or surface 18 and a second interior face or surface 19, both of which are substantially planar and parallel to each other. The first surface of the bottom section 16 has a centrally disposed hub 30 (see FIGS. 10 and 11), with reference to the longitudinal axis of the cylindrical housing 12, and the hub is substantially circular as viewed in plan. A continuous, open channel 32 (hereinafter sometimes referred to as the first channel) circumscribes the central hub so as to be concentric with and spaced inwardly from the cylindrical wall of the housing. A circumferential rim 34 extends from the channel 32 to about the perimeter of the cylindrical wall and is adjoined or formed integrally with the hub by the channel, as explained below in more detail. Thus, by reason of this particular arrangement or configuration of these features, the bottom, exterior face 18, as viewed in plan, comprises a central hub 30, an annular channel 32 which opens outwardly from the bottom wall and circumscribes the hub, and an outer circumferential rim 34, and these members are formed as an integral part of the bottom section 16.

The exterior, open channel or first channel 32 comprises spaced side walls 36 and 38 (see FIG. 10) extending inwardly from the bottom facing or wall 18, and preferably are substantially parallel with each other and with the cylindrical wall of the housing 12. It will be observed that the spaced side walls are concentric, thereby forming the channel having an inner side wall 36, defining the outer periphery of the hub 30, and an outer side wall 38, defining the inner periphery of the rim 34. These spaced side walls 36 and 38 of the channel are interconnected by a laterally disposed land or boss 40, thereby interconnecting the hub, channel and rim. Thus, the channel forms or defines an annular recess or opening in the bottom facing or wall of the cylindrical housing.

At the interior or second facing 19, which is opposed to and substantially parallel to the exterior facing 18, the hub 30 is provided with a substantially circular, center cavity or axial cavity 42 having a defined inner surface 44 and a radius extending from the longitudinal center axis of the cylindrical housing to the interior side wall 36 of the first channel 32. The center cavity or recess is of sufficient depth to accommodate a spring bias means 46, as described below in more detail. The land or boss 40 circumscribes the center cavity 42 and terminates at its outside circumference at the outer wall 38 of the channel 32. A second channel or recess 48, opening to the interior face 19 of the bottom section 18, circumscribes the land 40. An interior, circumferential rim 50 encircles the second channel 48 and extends to about the perimeter of the cylindrical housing.

A plurality of first and second, spaced slots 52 and 54 are formed at the opposed peripheries of the land or boss 40, and the slots 52 and 54 extend into and open longitudinally along the peripheries of the inner channel wall 36 and outer channel wall 38, respectively. The first slots 52 terminate at about the base of the hub 30 thereby forming a ledge or seat 56, and the second slots terminate at about the base of the rim 34 thereby forming a ledge or seat 58. By reason of this arrangement, as best shown in FIGS. 6, 7, 8 and 9, as viewed from the interior facing of the bottom section the first elongated slots 52 open onto the center cavity 42; and as best shown in these Figures, the second elongated slots 54 open onto the second or interior channel 48 as viewed from the interior facing of the bottom section. The longitudinal axes of the first slots 52 lie on a first common circle 60, and the longitudinal axes of the second slots 54 lie on a second common circle 62, and the two circles are concentric. (See FIG. 7, but only an arc of the circle is shown in order to avoid clutter.) The first slots are offset from the second slots, so that each of the first slots is disposed adjacent a pair of second slots, and vice-versa, thereby defining a zigzag pattern.

The apparatus of our invention further includes a plurality of first spaced apart pins 64 freely seated in the elongated slots 52 of the housing and are spaced outwardly from the longitudinal axis, that is, disposed on a common circle about the longitudinal axis as the center. Each of the first slots 52 is adaptable to receive a pin 64 and provides a seating for a pin including ledge 56. Thus, when the first pins are seated in the first slots, a portion of each pin protrudes through the slot of the inner wall 36 of the first channel 32 and outwardly therefrom and into the channel, as viewed from underneath. The ledge 56 provides a seat for the lower end portion of the pin. Similarly, a plurality of second spaced apart pins 66 are freely seated in the elongated slots 54 of the housing and disposed concentric to and outwardly from the first pins and offset therewith, so that each of the second pins is disposed adjacent the outer wall 38 of the first channel 32, and the ledge 58 provides a seat for the lower end portion of the pin. A portion of each second pin 66 protrudes from the slot 54 in the outer wall 38 and outwardly therefrom and into the first channel 32 and between adjacent first pins, as viewed from underneath. Thus, as a result of this disposition or arrangement of the pins, a portion of the longitudinal surface of each of the first and second pins protrudes in opposite directions from the opposed channel walls. Preferably, the seats 56 and 58 have a concave profile to accommodate the convexity of the pins, as explained below in detail.

Figure 13:
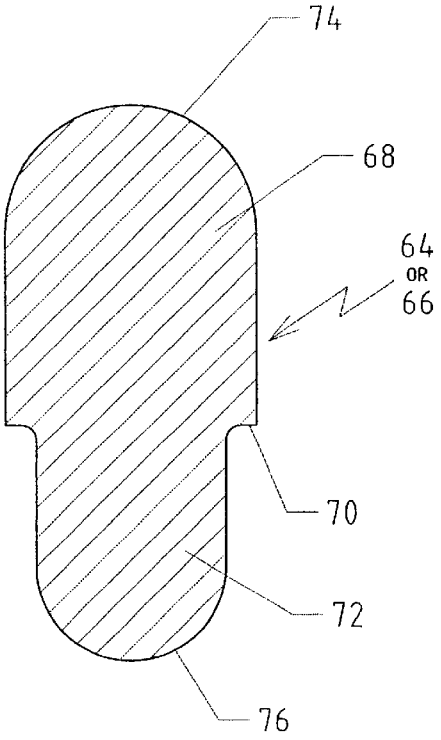
FIG. 13 is an elevational view in cross-section of a pin.
Figure 14:
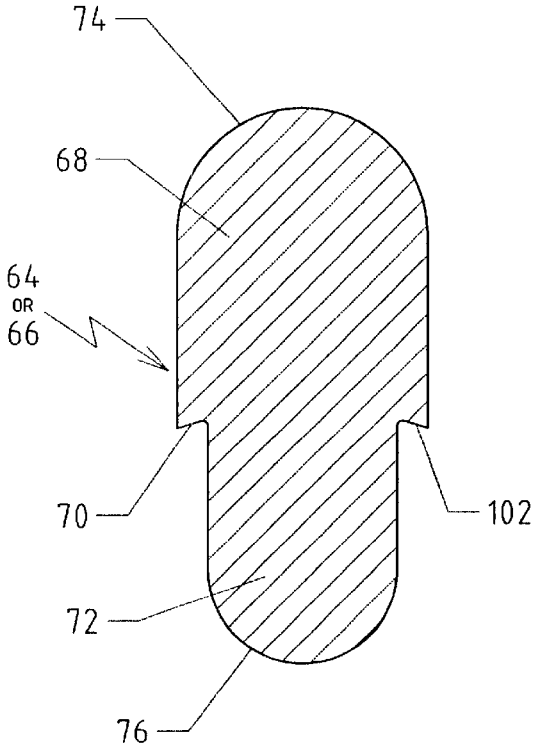
FIG. 14 is an elevational view in cross-section showing a modification of the pin.

In a preferred embodiment of the invention, and as best shown in FIGS. 13 and 14, each of the first and second pins 64 and 66, respectively, which preferably are elongated and have a circular cross-section, have an upper cylindrical section 68 of a first diameter, an inwardly directed annular shoulder 70, and a coaxial second cylindrical section 72 extending from the shoulder and of a smaller diameter than the first diameter. Each cylindrical section 68 and 72 has a substantially convex terminus 74 and 76, respectively. Thus, it will observed that the pins 64 and 66 are seated in the elongated slots 52 and 54, respectively, of the housing so that a portion of the smaller cylindrical section 72 and of the convex terminus 76 of each of the first and second pins protrudes radially from opposite channel walls 36 and 38, that is, protrude from the periphery of the walls and into the first channel 32. (See FIGS. 8 and 9.) The convex terminus 76 of each of the first and second pins seat on the complementary concave seats 56 and 58. A spring band 78, or other suitable bias means, is inserted into center axial cavity 42 to bias the first pins 64 radially outwardly relative to the center longitudinal axis so that a portion of each pin protrudes into the first channel 32. Similarly, suitable spring bias means 80 are inserted in channel 48 to bias the second pins 66 radially inwardly relative to this longitudinal axis and into the channel 32. In this manner, the pins 64 and 66 are biased radially and in opposite directions toward each other. The cap or top section 14 is mounted atop the assembly to retain the assembly in place. The top and bottom sections can be adjoined by providing aligned holes 82 and 84, repectively, to accommodate threaded bolts 86.

It will be observed in FIG. 13 that the inside diameter of shoulder 70, that is, the juncture of the shoulder with the smaller diameter section 72, is arcuate or rounded. This arcuate joint is significant because when the workpiece is raised into contact with the shoulder during the deburring operation, the arc puts a radius on the marginal edge of the workpiece. If this joint were orthogonal, the workpiece would have a sharp marginal edge which could be hazardous to the worker.

Figure 10:
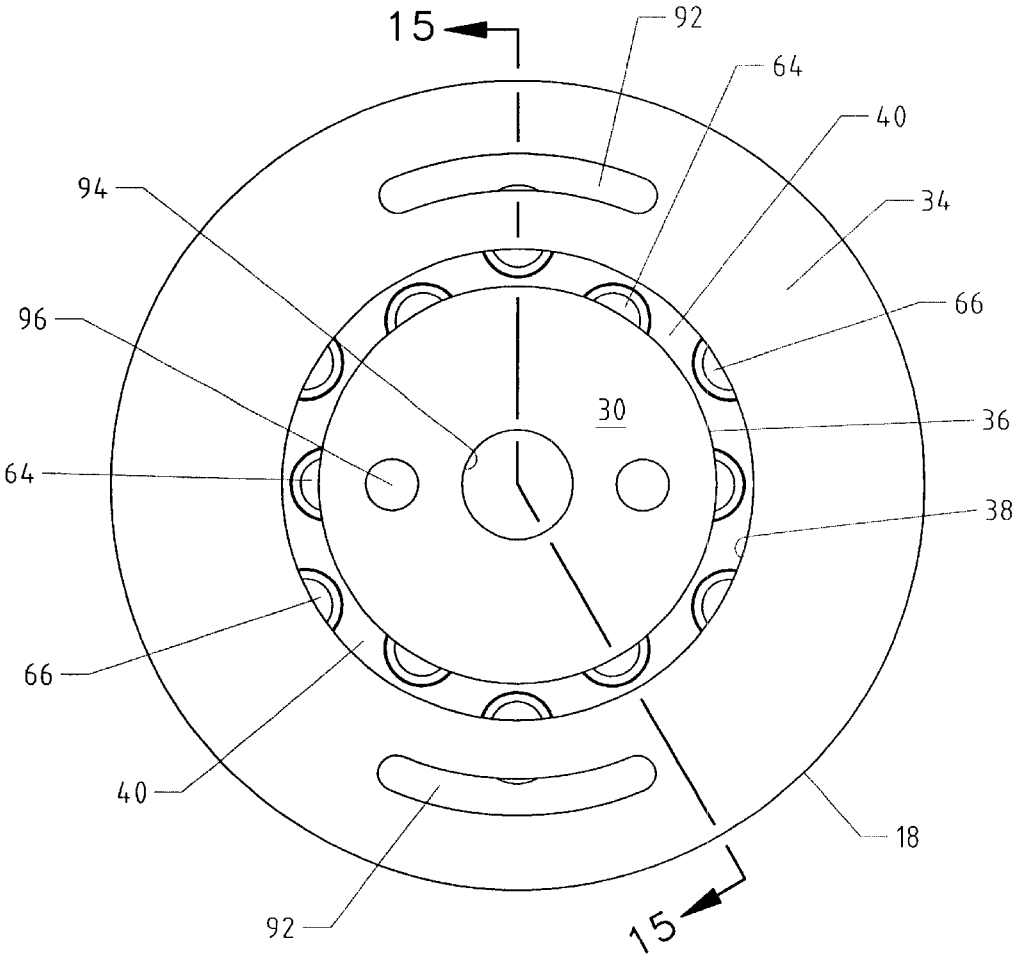
FIG. 10 is a plan view of the bottom section as viewed from underneath.
Figure 11:
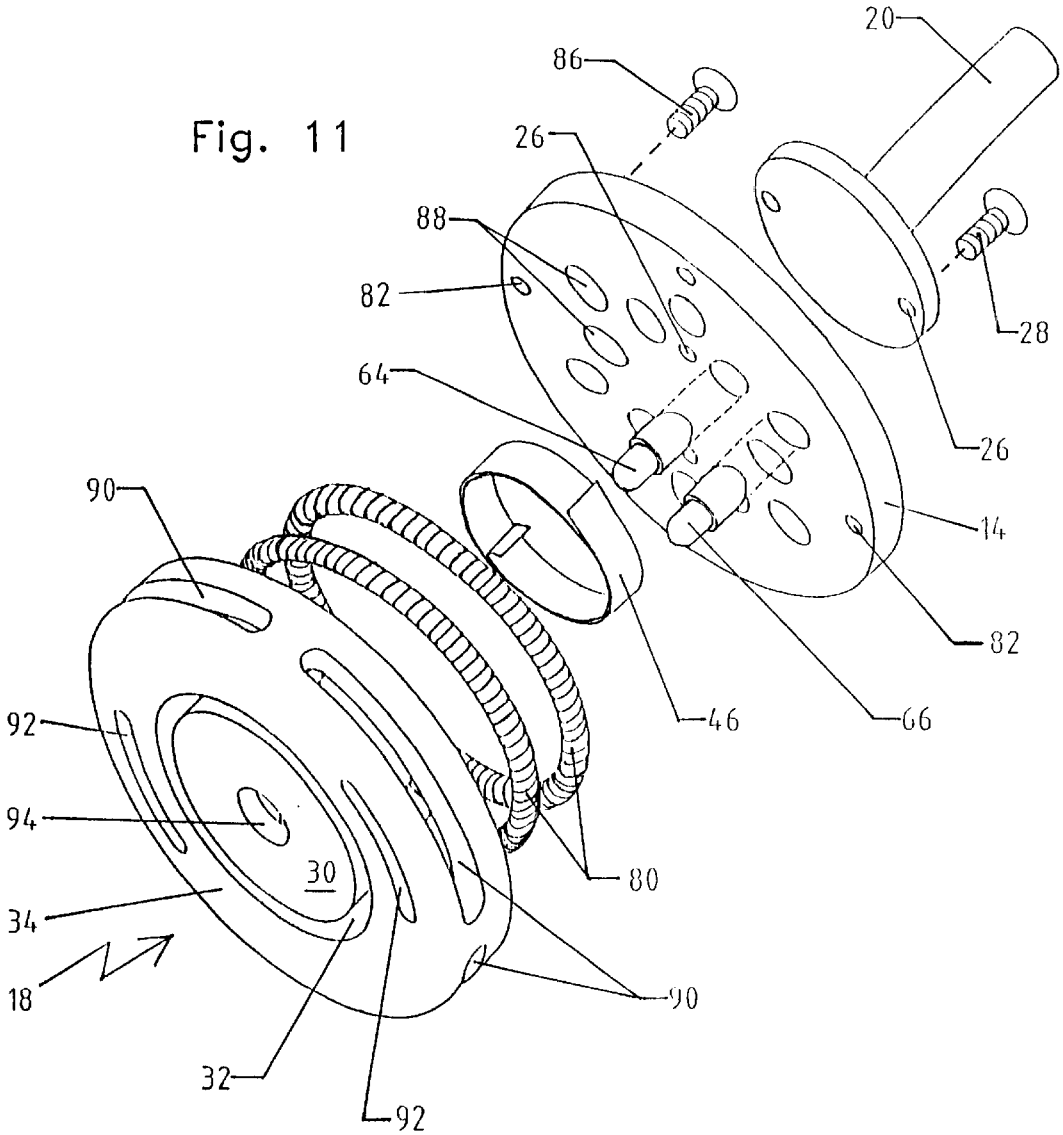
FIG. 11 is an exploded perspective of the deburring apparatus with two pins in an exploded position.
Figure 12:
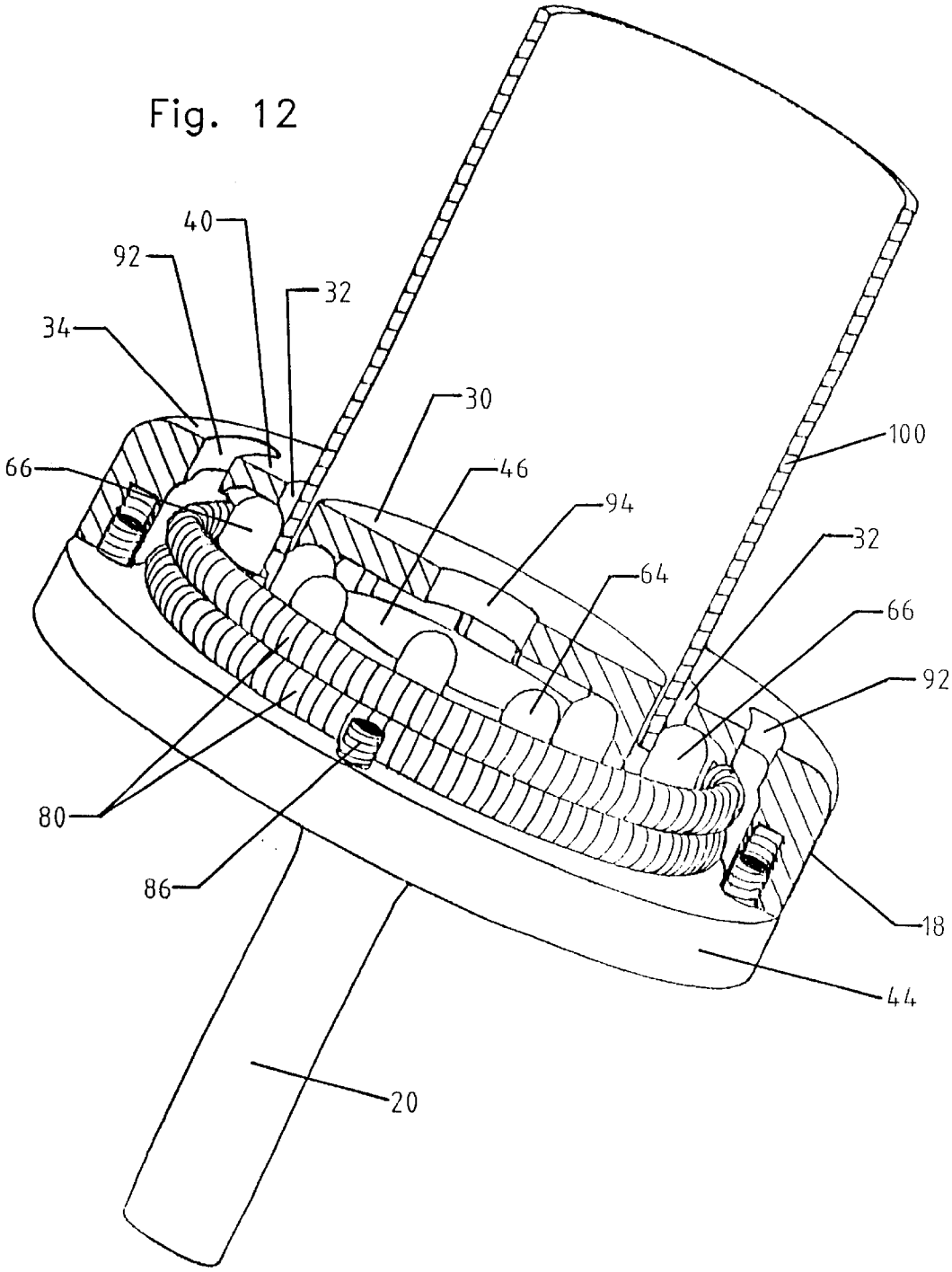
FIG. 12 is a partial cross-section of the deburring apparatus as viewed in perspective, with a cylindrical metal tube in place for deburring.

It will be observed that the pins 64 and 66 are seated in the housing, and are free to rotate upon rotation of the housing when the cylindrical workpiece to be deburred is brought into engagement with the pins, as explained below in detail. A portion of the convex terminus 76 and of the second smaller diameter section 72 of each of the first and second pins protrude from the slots into the channel from opposite directions. When viewed in plan, as shown in FIG. 10, the oppositely disposed surfaces of the cylindrical sections of each of the first and second pins lie on concentric circles. Thus, the outwardly disposed cylindrical surfaces of the first pins lie on a common circle of greater diameter than the common circle formed by the inwardly disposed cylindrical surfaces of the second pins. However, in the deburring operation, as explained below in detail, pressure applied against the pins by the metal body being fabricated separates the first and second pins in opposite directions against the bias, and as a consequence the oppositely disposed surfaces of the cylindrical sections of each of the first and second pins lie on concentric circles, but the diameter of the circle defined by the first pins is smaller than the diameter of the circle defined by the second pins.

The upper cylindrical section 68 of each pin has a convex terminus 74, which extends beyond or upwardly from the slot in the land or boss 40. The cap or top section 14 is provided with a plurality of recesses 88 which are about complementary with the convex termini 74 so as to accommodate the termini. When the cap is joined or connected to the bottom section of the housing, the pins are retained in position. In a preferred embodiment of the invention, the recesses 88 are slightly larger than the circumference or the diameter of section 68 of the pins so as to provide a floating action for the pins. The recesses are parti-oval in configuration, thereby defining an elongated somewhat oval recess having a configuration, in plan, such that a significant portion of the opposed ends is oval adjoined by rectilinear lines. Allowing for this floating action is especially important when deburring a workpiece having irregularities, i.e., a weld seam, or out-of-round. Thus, the deburring tool of our invention can be utilized for tubular workpieces having some ovaliform, e. g., as much as about 0.10 out of oval.

When the apparatus is used for deburring metal cylinders there is a tendency for heat build-up, which can impair the operation. Also, a portion of the small metal fines removed from the workpiece will remain in the apparatus. In order to overcome these difficulties, the cylindrical housing is provided with a plurality of apertures or holes. As shown in the drawings, the cylindrical wall of the bottom section 16 has two or more arcuate apertures 90 which extend from the wall and open onto the second channel 48, thereby exposing the channel and the spring bias means to facilitate cleaning and to allow for heat dissipation. Similarly, rim 34 has two or more arcuate apertures 92 which extend from the rim and open onto the second channel 48. Additionally, we have found it advantageous to provide the hub 30 with a relatively large center hole 94 preferably encircled by a plurality of spaced, smaller holes 96 (see FIG. 10), all of which opens to the cavity 42. In this manner, heat generated during use is more easily dissipated through the apertures or holes. Also, an air hose and/or brush can be easily used or applied at the holes to blow out or brush out the metal fines.

For example, a deburring apparatus of our invention having a housing with a diameter of about 5 and ½ to 6 inches, the workpiece can be about 2 and ½ to 3 inches in diameter. The housing can have about four apertures 90 in the cylindrical wall, about six apertures 92 in the rim, a center hole 94 in the hub, and about six small holes 96 in the hub. A suitable number of pins 64 and 66 for this size device would be about six of each. The housing is typically rotated at a speed of about 700 to 2,000 rpm, but the rotational speed can vary and will depend largely upon such factors as the size of the tool and the size of the workpiece.

Figure 15A:
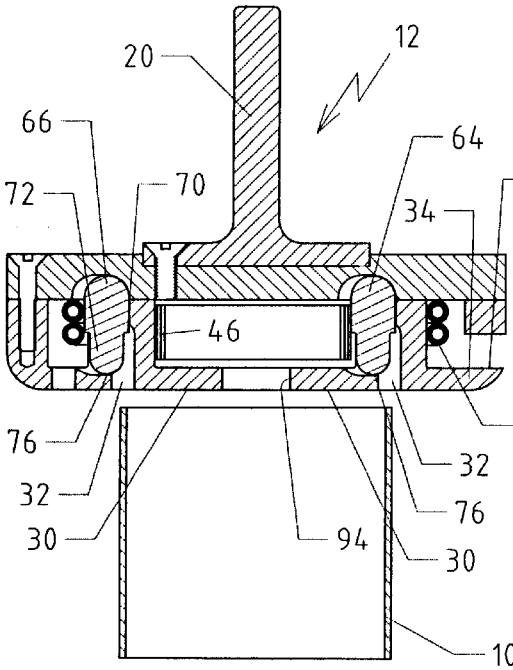
FIG. 15A is a cross-sectional view of the deburring apparatus on line 15—15 of FIG. 10 showing a cylindrical metal tube placed out of contact with the pins of the apparatus.
Figure 15B:
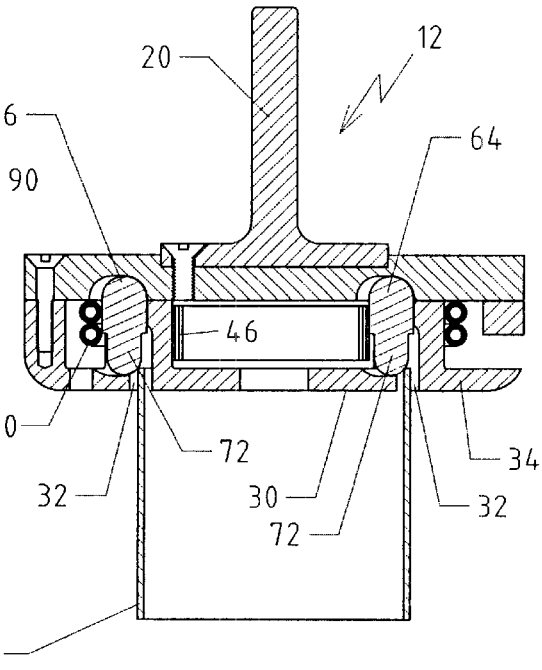
FIG. 15B is a cross-sectional view similar to FIG. 15A on line 15—15 of FIG. 10 showing a cylindrical metal tube entering the pin radius defined by the convex terminus of the pin.
Figure 15C:
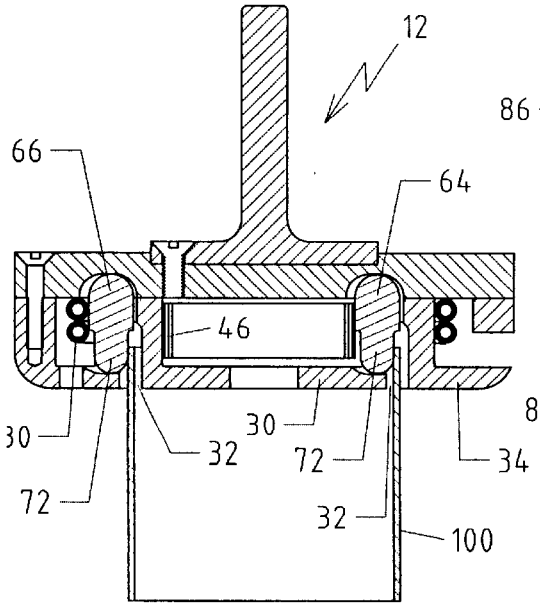
FIG. 15C is a cross-sectional view similar to FIG. 15A on line 15—15 of FIG. 10 showing a cylindrical metal tube entering the small diameter of the pins.
Figure 15D:
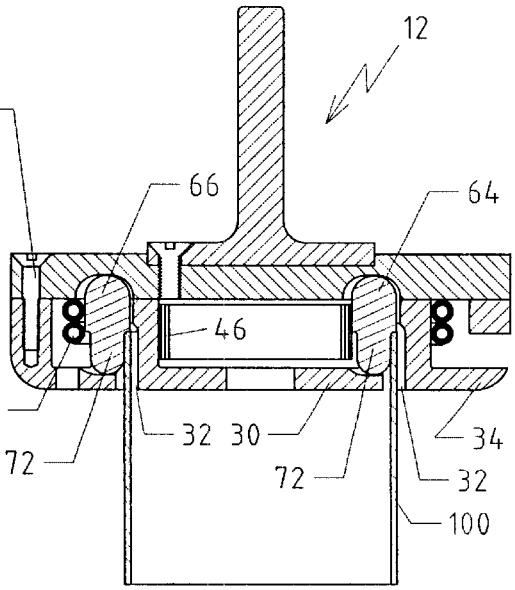
FIG. 15D is a cross-sectional view similar to FIG. 15A on line 15—15 of FIG. 10 showing a cylindrical metal tube abutting the annular shoulder of the pins.

Referring now to FIGS. 15A–D, illustrating the deburring operation of a cylindrical metal body or tube 100, the apparatus is connected to a machine so that the housing 12 is rotated at a high speed. The tube is raised into position so that the marginal edge of the cylindrical workpiece is adjacent the first channel 32, as shown in FIG. 15A. As the housing is rotated, the first deburring step occurs when the tube is raised into the channel, manually or mechanically, and into contact or engagement with the convex bottom portion or termini 76 of the first pins 64 and second pins 66. (See FIG. 15B.) Upon contact between the marginal edge of the workpiece and the convex termini, the pins rotate and the edge of the workpiece is deburred at least partially during this first step or stage of the operation. The second step occurs, as shown in FIG. 15C, as the tube continues to rise or be inserted into the zone between the first and second pins and into engagement or contact with the smaller diameter section 72 of the first and second pins. The pressure applied against the pins displaces the pins radially in opposite directions relative to the center longitudinal axis of the housing, and thereby separating the first and second pins so that the tube contacts the wall of smaller diameter section of each pin. The third and final step occurs, as shown in FIG. 15D, when the tube is raised or inserted so that the marginal edge of the tube abuts the annular step or shoulder 70 of each pin. It will be observed that as the tube is brought into contact with the pins, the wall of the tube separates the pins but the bias means forces the pins against the tube to maintain contact between the pins and the workpiece, and rotation of the pins continues to effect deburring of the marginal edge of the workpiece during the three process steps. The housing rotates with the pins, and the pins deburr the tube in these three steps. When the operation is completed, the tube is then disengaged from any contact with the deburring tool.

In accordance with a modification of the invention, the shoulder 70 of pins 64 and 66 is provided with an angle of relief 102 relative to the horizontal. This inwardly directed slope provides a cutting edge or knife edge for the pin. Thus, the deburring tool can cut and deburr the marginal edge of the workpiece. The angle of relief can be about 3° to 7°, and preferably about 5°. The angle should be sufficient to provide a cutting edge, but not too great as to have a thin edge exhibiting a weakness prone to cracking.

It will be observed that the deburring apparatus of our invention provides for several advantages, including the fact that the apparatus is not complicated to use and requires no special or unusual skill. A smooth edge of the workpiece is easily achieved when the device is used to deburr the edges of a tube or the like. Most significantly, the workpiece is not deformed from the deburring operation. Also, it is possible to process a workpiece with irregularities, and to cut and deburr the workpiece in one operation. Further, it should be understood that the foregoing detailed description has been given for clearness of understanding only, and no unnecessary limitations should be understood therefrom, as modifications will be obvious to those skilled in the art.

What is claimed is:

1. An apparatus for deburring the marginal edge of a cylindrical body, the apparatus comprising:

(a) a cylindrical housing adaptable for rotatable mounting having a substantially planar bottom surface with a center hub, and a continuous channel circumscribing said hub and having spaced inner and outer sidewalls extending inwardly from said bottom surface and opening outwardly in said bottom surface, said inner and outer sidewalls having a plurality of spaced elongated slots offset from each other;

(b) a plurality of first pins seated in said housing adjacent said inner sidewall so that at least a portion of each of said first pins protrudes from said slot into said channel; and a plurality of second pins seated in said housing adjacent said outer sidewall so that at least a portion of each of said second pins protrudes from said slot into said channel, said second pins disposed concentric to and generally outwardly from said first pins and offset therewith so that each of said second pins is disposed between adjacent said first pins; and (c) means to bias said first pins and said second pins radially in opposite directions toward each other and to be displaceable radially in opposite directions.

2. An apparatus for deburring the marginal edge of a cylindrical body, the apparatus comprising:

(a) a cylindrical housing adaptable for rotatable mounting having a substantially planar bottom surface, and an inwardly disposed continuous channel opening in said bottom surface, said channel having spaced concentric, inner and outer sidewalls substantially normal to said bottom surface, said inner and outer sidewalls having a plurality of spaced elongated slots offset from each other;

(b) a plurality of first spaced apart pins seated in said housing adjacent said slots of said inner sidewall, and a plurality of second spaced apart pins seated in said housing and disposed concentric to and generally outwardly from said first pins and offset therewith so that each of said second pins is disposed adjacent said slots of said outer sidewall and between adjacent said first pins;

(c) each of said first and second pins having a substantially cylindrical section and a convex terminus, and seated so that at least a portion of said cylindrical section and of said convex terminus of each of said first and second pins protrudes from said slots into said channel; and (d) means to bias said first and second pins radially toward each other and to be displaceable radially in opposite directions relative to the longitudinal axis of said cylindrical housing.

3. An apparatus for deburring the marginal edge of a cylindrical body, comprising:

(a) a substantially enclosed cylindrical housing having (i) a circular hub, (ii) a continuous, open channel circumscribing said hub, and (iii) a circumferential rim disposed radially from said channel;

(b) said channel having (i) an inner sidewall defining the outer wall of said hub and an outer sidewall defining the inner wall of said rim, and (ii) a laterally disposed annular boss adjoining said inner and outer sidewalls thereby connecting said hub and said rim;

(c) a plurality of first, spaced elongated slots and second, spaced elongated slots extending transversely through said boss and opening longitudinally in the peripheries of said inner and outer sidewalls whereby said first slots open through a portion of said inner sidewall and said second slots open through a portion of said outer sidewall; said first slots offset from said second slots and disposed radially and generally outwardly from said first slots;

(d) a plurality of first pins seated in said first slots so that a portion of each of said first pins protrudes from the periphery of said inner sidewall and into said channel; and a plurality of second pins seated in said second slots so that a portion of each of said second pins protrudes from the periphery of said outer sidewall and into said channel, whereby said second pins are disposed concentric to and generally outwardly from said first pins and offset therewith so that each of said second pins is disposed between adjacent said first pins; and (e) means to bias said first pins and said second pins radially in opposite directions toward each other and to be displaceable radially in opposite directions.

4. An apparatus for deburring the marginal edge of a cylindrical body according to claim 1 or claim 3 wherein each of said first and second pins have a substantially cylindrical section and a convex terminus, and seated so that a portion of said cylindrical section and of said convex terminus of each of said first and second pins protrude from said slots into said channel.

5. An apparatus for deburring the marginal edge of a cylindrical body according to any one of claims 1, 2 or 3 whereby said first slots are disposed in a first common circle and said second slots are disposed in a second common circle, such that when the apparatus is in a non-operating condition, said first circle of said first pins is of larger diameter than said second circle of said second pins.

6. An apparatus for deburring the marginal edge of a cylindrical body according to claim 4 whereby said first slots are disposed in a first common circle and said second slots are disposed in a second common circle, such that when the apparatus is in a non-operating condition, said first circle of said first pins is of larger diameter than said second circle of said second pins.

7. An apparatus for deburring the marginal edge of a cylindrical body according to claim 1, 2 or 3 wherein each of said first and second pins have a substantially cylindrical section and a first convex terminus and an opposed second convex terminus, and seated so that a portion of said cylindrical section and said first convex terminus of each of said first and second pins protrude from said slots into said channel, and said housing further includes a cap having a plurality of spaced recesses adaptable for accommodating said second convex terminus of each of said first and second pins.

8. An apparatus for deburring the marginal edge of a cylindrical body according to claim 7 whereby said first slots are disposed in a first common circle and said second slots are disposed in a second common circle, such that when the apparatus is in a non-operating condition, said first circle of said first pins is of larger diameter than said second circle of said second pins.

9. An apparatus for deburring the marginal edge of a cylindrical body according to claim 1, 2 or 3 wherein said hub includes an axial cavity opening to said cylindrical housing, said first slots opening to said cavity, bias means disposed in said cavity to bias said first pins radially outwardly; a second channel opening to said cylindrical housing concentric with said cavity and adjacent said second slots so that said second slots open to said second channel, and bias means disposed in said second channel to bias said second pins radially inwardly.

10. An apparatus for deburring the marginal edge of a cylindrical body according to any one of claims 1, 2 or 3 wherein said housing includes a center hub and a plurality of first, spaced elongated slots and second, spaced elongated slots whereby said first slots open through a portion of said inner sidewall and said second slots open through a portion of said outer sidewall; said first slots offset from said second slots and disposed radially and generally outwardly from said first slots; said first slots are disposed in a first common circle and said second slots are disposed in a second common circle, such that when the apparatus is in a non-operating condition, said first circle of said first pins is of larger diameter than said second circle of said second pins; each of said first and second pins have a substantially cylindrical section and a first convex terminus and an opposed second convex terminus, and seated so that a portion of said cylindrical section and said first convex terminus of each of said first and second pins protrude from said slots into said channel; said housing further includes a cap having a plurality of spaced recesses adaptable for accommodating said second convex terminus of each of said first and second pins; said hub includes an axial cavity opening to said cylindrical housing, and said first slots opening to said cavity; bias means disposed in said cavity to bias said first pins radially outwardly; and a second channel opening to said cylindrical housing concentric with said cavity and adjacent said second slots so that said second slots open to said second channel; and bias means disposed in said second channel to bias said second pins radially inwardly.

11. An apparatus for deburring the marginal edge of a cylindrical body according to any one of claims 1, 2 or 3 wherein said slot in said inner sidewall terminates with a transverse shoulder to provide a seat for said first pins, and said slot in said outer sidewall terminates with a transverse shoulder to provide a seat for said second pins.

12. An apparatus for deburring the marginal edge of a cylindrical body according to any one of claims 1, 2 or 3 wherein each of said first and second pins have a circular cross-section, an upper cylindrical section of a first diameter, an inwardly directed annular shoulder, a coaxial second cylindrical section extending from said shoulder and of a smaller diameter than the first diameter, and a convex terminus, and said first and second pins are seated in said slots so that a portion of said shoulder, of said second cylindrical section and of said convex terminus of each of said first and second pins protrudes into said channel.

13. An apparatus for deburring the marginal edge of a cylindrical body according to claim 12 wherein said annular shoulder is substantially normal to said second cylindrical section.

14. An apparatus for deburring the marginal edge of a cylindrical body according to claim 12 wherein said annular shoulder is at an acute angle not exceeding about 7° relative to the horizontal to provide a knife edge.

15. An apparatus for deburring the marginal edge of a cylindrical body according to claim 14 wherein said acute angle is about 5°.

16. An apparatus for deburring the marginal edge of a cylindrical body according to claim 10 wherein said wherein each of said first and second pins have a circular cross-section, an upper cylindrical section of a first diameter, an inwardly directed annular shoulder, a coaxial second cylindrical section extending from said shoulder and of a smaller diameter than the first diameter, and a convex terminus, and said first and second pins are seated in said slots so that a portion of said shoulder, of said second cylindrical section and of said convex terminus of each of said first and second pins protrudes into said channel.

17. An apparatus for deburring the marginal edge of a cylindrical body according to claim 16 wherein said annular shoulder is substantially normal to said second cylindrical section.

18. An apparatus for deburring the marginal edge of a cylindrical body according to claim 16 wherein said wherein said annular shoulder is at an acute angle of about 5° relative to the horizontal to provide a knife edge.

19. An apparatus for deburring the marginal edge of a cylindrical body, and including (a) a cylindrical housing adaptable for rotatable mounting having a substantially planar bottom surface with a center hub, and a continuous channel circumscribing said hub and having spaced inner and outer sidewalls extending inwardly from said bottom surface and opening outwardly in said bottom surface, said inner and outer sidewalls having a plurality of spaced elongated slots offset from each other, (b) a plurality of first spaced apart pins seated in said housing adjacent said inner sidewall, and a plurality of second spaced apart pins seated in said housing and disposed concentric to and outwardly from said first pins and offset therewith so that each of said second pins is disposed adjacent said outer sidewall and between adjacent said first pins, (c) each of said first and second pins having a cylindrical section, an inwardly directed annular shoulder, and a convex terminus, and seated so that at least a portion of said cylindrical section and of said convex terminus of each of said first and second pins protrudes from said slots into said channel; and (d) means to bias said first pins and said second pins radially in opposite directions toward each other and to be displaceable radially in opposite directions, by the process which comprises the sequential steps, as the housing is being rotated, contacting the cylindrical body with the convex terminus of the first and second pins; tehn contacting the cylindrical body with the cylindrical section of the first and second pins so as to displaces the pins radially in opposite directions relative to the center longitudinal axis of the housing; and then contacting the cylindrical body so that the marginal edge of the cylindrical abuts the annular shoulder of each pin; and then removing the cylindrical body from the apparatus.

20. In an apparatus according to claim 16 wherein the annular shoulder of the pins have an angle of relief relative to the horizontal to form a knife edge, whereupon contact of the marginal edge of the cylindrical body concomitantly cuts the marginal edge.

* * * * *